US005465799A

United States Patent [19]

Ho

[11] Patent Number: 5,465,799

[45] Date of Patent: Nov. 14, 1995

[54] SYSTEM AND METHOD FOR PRECISION DOWNHOLE TOOL-FACE SETTING AND SURVEY MEASUREMENT CORRECTION

[76] Inventor: Hwa-Shan Ho, P.O. Box 11170, Spring, Tex. 77391-1170

[21] Appl. No.: 231,817

[22] Filed: Apr. 25, 1994

[51] Int. Cl.[6] ..... E21B 7/04; E21B 7/08

[52] U.S. Cl. ..... 175/61; 175/45; 175/74

[58] Field of Search ..... 175/45, 61, 74; 33/302, 304

[56] References Cited

U.S. PATENT DOCUMENTS

| | | | |
|---|---|---|---|
| 2,676,820 | 4/1954 | Boice . | |
| 3,554,307 | 1/1971 | Yount . | |
| 3,666,022 | 5/1972 | Bailey et al. . | |
| 3,730,286 | 1/1973 | Weiner . | |
| 4,433,491 | 2/1984 | Ott et al. | 33/302 |
| 4,472,884 | 9/1984 | Engehretson | 33/304 |
| 4,682,421 | 7/1987 | Van Dongen et al. | 33/302 |
| 4,709,486 | 12/1987 | Walters | 33/304 |
| 4,804,051 | 2/1989 | Ho | 175/26 |
| 4,811,800 | 3/1989 | Hill et al. . | |
| 4,848,144 | 7/1989 | Ho | 73/151 |
| 4,894,923 | 1/1990 | Cohern et al. | 33/304 |
| 4,972,703 | 11/1990 | Ho | 73/151 |
| 5,012,412 | 4/1991 | Helm | 33/302 X |
| 5,040,622 | 8/1991 | Winship et al. . | |
| 5,044,198 | 9/1991 | Ho | 73/151 |
| 5,139,094 | 8/1992 | Prevedel et al. | 175/61 |
| 5,358,059 | 10/1994 | Ho | 175/45 |

*Primary Examiner*—Ramon S. Britts
*Assistant Examiner*—Frank S. Tsay
*Attorney, Agent, or Firm*—Harrison & Egbert

[57] ABSTRACT

A method determining a tool face angle of a downhole drilling assembly in a well bore including the steps of determining an apparent tool face angle, measuring torque at least at one downhole axial location along the drillstring in the well bore, correlating a change in the apparent tool face angle relative to a change in the torque so as to produce a graphical curve of the correlation, and identifying a slope discontinuity along the graphical curve. The slope discontinuity is indicative of a contact resistance between the drillstring and the well bore. This method further includes the steps of determining a differential twist angle from the graphical curve and inferring a true tool face angle by subtracting the differential twist angle from the apparent tool face angle. The step of determining the apparent tool face angle includes measuring the inclination angle and azimuth angle of the well bore. The torque is measured at substantially the same axial location as the apparent tool face angle. The torque or rotation applied to the drillstring is adjusted so as to obtain a desired true tool face angle.

18 Claims, 4 Drawing Sheets

SYSTEM AND METHOD FOR PRECISION DOWNHOLE TOOL-FACE SETTING AND SURVEY MEASUREMENT CORRECTION

TECHNICAL FIELD

The present invention relates to methods for facilitating the directional drilling of oil and gas wells. More particularly, the present invention relates to methods for determining and setting proper tool-face angles in such directional drilling operations.

BACKGROUND ART

The oil and gas drilling industry has been undergoing dramatic technology improvements in the last decade, particularly in MWD (Measurement-While-Drilling), directional and horizontal drilling, improved drilling tools and equipment and improved analysis and monitoring capabilities. The combined effect is that drilling cost has been steadily declining, and directional drilling, particularly high-angle, extended reach, and horizontal drilling have become much more popular, and will further see expanded application in the future.

At the same time, due to operators' cost cutting efforts and down-sizing, more and more wells are being drilled on a "turn-key" basis, whereby service companies are asked to contract the entire drilling project at a predetermined benchmark fee, with huge incentives for faster and better drilling, and similar penalties for incurring drilling problems and drilling delays.

The advent of these turn-key projects creates an economic condition under which service companies that are able to improve aspects of the entire drilling operation will reap major profits, and those who do not may suffer major losses. One single severe incident of stuck-pipe can mean a loss of hundreds of thousands of dollars in revenue loss, and possibly more.

As a result, there are important considerations facing the next generation of directional drilling. First, it is important to maximize the length of each bit run. This requires the use of long-life PDC bits, MWD measurements which do not require additional wireline reconfirmation runs, and proper trajectory control. Secondly, it is necessary to minimize the need for course corrections. In rotary drilling, course correction requires tripping, which is very expensive in long reach wells. It also frequently shortens the bit life. In downhole motor drilling, course correction means more crooked borehole paths, resulting in increased torque and drag. The time involved in course correction not only impacts the drilling time, but may also adversely impact hole stability and the formation evaluation process. Thirdly, it is important to improve the initial well path planning. Well paths should be planned to account for the natural deviation and walk tendencies of the drilled well path due to the interaction of the BHA-bit-formation system. Imposing unrealistic well path designs will result in more frequent course corrections or can cause the missing of the target. Currently most wells are planned as 2-D wells. If the natural walk tendency is strong, this will drastically increase the number of course corrections required. Fourthly, smooth well paths are desirable. This requires improved MWD directional surveys, improved trajectory control, by a combination of active trajectory deflection means, and preferably combined with a physically sound simulation of the phenomenon of the intrinsic drilling deviation and walk tendencies due to the interaction of the BHA-bit-formation system. Additionally, it is preferable to maximize the horizontal section of the horizontal well. It is recognized that increasing the horizontal section greatly increases the effective recovery area of the reservoir, reduces the unit drilling cost, and may enable many marginal fields to become economically feasible for development. The major current limitation to the length of the horizontal section is torque and drag. Part of the problem is that the horizontal section is not a straight nor smooth section. It actually consists of a series of alternating and meandering curved sections. This is due to the current practice of using bent housing assemblies and alternating sliding and rotary drilling. To improve the straightness of the horizontal section, it is necessary to reduce the inherent build tendency of the downhole assembly, and to improve the tool face setting operations. For such purpose, a better understanding and control on what really happens to the downhole motor/bent housing assembly is very important. Relying on a sophisticated downhole BHA analysis program is insufficient. Additional downhole measurements are needed to better define the behavior of the assembly.

In directional drilling, especially in long reach, high angle, or horizontal drilling, great emphasis is placed in long bit runs, smooth and properly controlled well paths, and minimal course corrections. Otherwise, major drilling difficulties can develop. In actual drilling, many downhole trajectory control devices are used to deflect the drilling trajectory whenever necessary. These include downhole bent housings of the downhole motor, bent subs or whipstocks, and other active or adjustable devices such as adjustable stabilizers. To properly execute the trajectory deflection, it is very important to set the tool face accurately.

A current method of setting the tool face angle relies on measuring the tool face angle at the location where downhole survey sensors are located in the BHA (bottomhole assembly). However, due to the interference fit caused by such downhole deflection devices, significant contact forces are generated by such devices at the contact points (i.e., the bent knee and the intervening stabilizers). These restraining torques prevent the bent knee from turning when the surface torque is applied. Therefore, the "apparent tool face" at the sensor location very often differs significantly from the true tool face angle at the bent knee.

The prior art method of downhole tool face setting is to infer the tool face at the axial location where the survey sensors are located through survey measurements. The effect of the "restraining torque" at the bent knee and any other intervening contact locations (such as the upper stabilizer of the downhole motor) is not accounted for. As a result, it not only affects the accuracy of the tool face, but also the azimuth accuracy of the directional survey, since the survey data are influenced by the deformation of the downhole assembly. It is accepted that the azimuth accuracy in MWD survey, particularly near the horizontal section, is very poor. Errors of over two degrees in azimuth from such surveys are fairly common. The uncertainty of the well trajectory, due to such azimuthal error, will either lead to strayed drilling or to a crooked horizontal well path. This greatly limits the maximum drillable horizontal extent of the well.

Various U.S. patents have issued to the present inventor in the field of the present invention. U.S. Pat. No. 4,848 144 (issued on Jul. 18, 1989), U.S. Pat. No. 4,972,703 (issued on Nov. 27, 1990), and U.S. Pat. No. 5,044,198 (issued on Sep. 3, 1991) have addressed methods of predicting the torque and drag in directional wells. These patents describe a method for generating an improved torque-drag model for at least the collar portion of the drillstring in a directional oil or gas well. The techniques of these patents determine the stiffness of incremental portions of the drillstring, and uses this information, along with the borehole clearance and the borehole trajectory, to determine the contact locations between the drillstring and the sidewalls of the well. The contact force at these determined locations can be calculated, taking into consideration all significant kinematic, external, and internal forces acting on that incremental portion of the drillstring. More accurate torque-drag analysis, provided by the model of these patents, assists in well planning, prediction and control, and assists in avoiding drilling problems. This method serves to reduce total costs for the well.

It is an object of the present invention to provide a method for accurately setting the tool face angle.

It is another object of the present invention to provide a method that can more effectively control the straightness of the horizontal or directional drilling borehole.

It is a further object of the present invention to provide a method that can provide greater information concerning the borehole path profile.

It is still a further object of the present invention to provide a method which can minimize the problems of directional drilling.

These and other objects and advantages of the present invention will become apparent from a reading of the attached specification and appended claims.

SUMMARY OF THE INVENTION

The present invention is a method of determining a tool face angle in a well bore comprising the steps of: (1) determining an apparent tool face angle; (2) measuring torque at least at one axial location along the drillstring in the well bore; (3) correlating a change in the apparent tool face angle relative to a change in the torque so as to produce a graphical curve of the correlation; and (4) identifying a slope discontinuity along the graphical curve. The slope discontinuity is indicative of a contact resistance between the drillstring and the well bore.

If the slope discontinuity is a curve segment, then the step of identifying includes the step of computing a curvature of the curve segment. This curvature is representative of a distributed contact resistance along an area of contact between the drillstring and the well bore.

The method of the present invention also includes the steps of: (1) determining a differential twist angle from the graphical curve, and (2) infering a true tool face angle by substracting the differential twist angle from the apparent tool face angle. The step of determining the apparent tool face angle includes the steps of measuring an inclination angle of the well bore, and measuring an azimuth angle of the well bore. Specifically, a sensor sub is attached to a section of the drillstring above a bent housing on the drillstring. The sensor sub has a plurality of accelerometers and magnetometers thereon. The step of measuring torque includes measuring the torque at substantially the same axial location as the sensor sub. The step of identifying the slope discontinuity includes the step of locating the slope discontinuity relative to a position below the bend of the bent housing. This step also includes the steps of: (1) computing a slope of the graphical curve so as to yield an instantaneous rotational compliance under any given applied torque; (2) determining an effective depth of a contact load from the slope; and (3) inferring a presence and a magnitude of a concentrated contact restraining torque from the slope discontinuity. The torque applied to the drillstring is adjusted so as to obtain a desired true tool face angle.

In the method of the present invention, an incremental torque can be inferred relative to an incremental tool face angle from the graphical curve, until free rotation of the entire assembly occurs.

In another embodiment of the present invention, the present invention includes a method of setting a true tool face angle at the bent knee of the drillstring in a well bore.

The present invention provides a system of tool face setting and downhole tool performance evaluation by improved measurements and interpretation of the actual behavior of the downhole tool. In addition to measuring the survey data at the survey sensor location, additional measurements can also be carried out. First, torque measurement is made at the same axial location as the survey sensor. This can be used to infer the precise tool face of the downhole tool at the point of contact. Secondly, additional measurements of bending moments and shear forces can be taken at or near the contact point of the downhole tool. These measurements can be used to infer the deformation of the downhole tool, and to infer the borehole caliper. It can also be used to further correct for the effect on the locking restraining torque of the tool face angle relative to the high side of the well. This will serve to improve the accuracy of the tool face setting procedure.

The present invention provides a means of accurately setting the tool face angle at the major contact locations such as the bent knee of a downhole motor or any downhole deflection device, by using additional measurements at substantially the same axial location of the downhole assembly. In addition to the existing survey measurements which permit the computation of the tool face angle at the measurement location, the measurements by the present invention also include the drillstring torque measurement.

Additional force resultant measurements at substantially the same location will provide useful information about the borehole path profile, and the amount of interference fit, which serves as an accurate well bore caliper, and provides detailed information about the well path. It will also improve the accuracy of setting the tool face angle by correcting for the effect of the relative tool face high side angle to the locking restraint torque. The information is very important to warn of potential drilling problems due to excessive well bore crookedness.

DETAILED DESCRIPTION OF THE INVENTION

Figure 1:
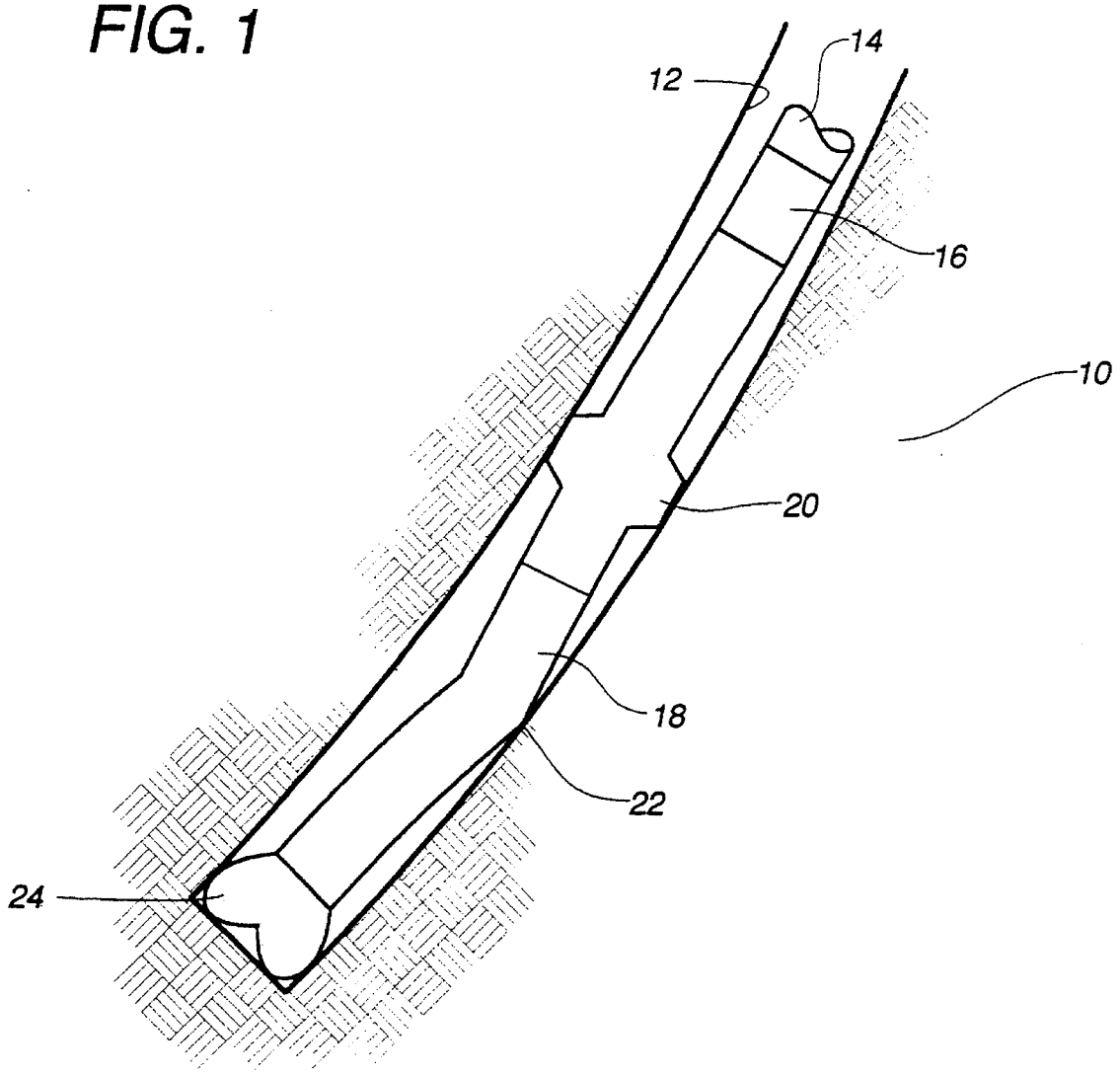
FIG. 1 is a diagrammatic view of the downhole application of the present invention.

FIG. 1 illustrates the downhole assembly 10 in accordance with the method of the present invention. The downhole assembly 10 is positioned within a well bore 12 in a directional drilling operation. It can be seen that a drillstring 14 extends downwardly into the borehole 12. A sensor sub 16 is positioned on the drillstring 14. The sensor sub can contain accelerometers and magnetometers for determining the inclination angle and the azimuth angle of the drillstring and/or the well bore. The sensor sub 16 is positioned along the drillstring 14 normally above the bent housing 18. The drillstring is supported within the borehole 12 through the use of a stabilizer 20. The stabilizer 20 serves to urge the drillstring 14 into a relatively centered position with respect to the borehole 12. The stabilizer 20 has sides which contact the borehole 12. The bent housing 18 includes a bent knee 22 which contacts an inner wall of the borehole 12. The bent housing 18 can contain the downhole bore motor therein. The downhole motor within the bent housing 18 can drive the bit 24 at the bottom of the borehole 12. The bent knee 22 has a bend which can determine the tool face angle in the drilling operation.

At the downhole location 10, there is a downhole motor with the bent housing 18 whose bend angle forces the drillbit 24 to build, drop, or drill sideways (depending upon the tool face angle of the bent housing 18), due to the very large side forces generated at the bit 24 because of the interference fit. The tool face angle is the angle between the plane of the bent housing 18 at the bent knee 22 and the vertical plane containing the tangent line of the well path 12 at the bent knee. The tool face angle also defines the relative contact angle of the bent knee 22 with respect to the borehole wall.

When the tool face angle is zero, the bent knee 22 sits at the low side of the borehole 12, and the assembly will ideally build its angle without walking. When the tool face angle is 90°, the bent knee 22 sits at the left side of the borehole wall when viewed from the top, and the assembly will ideally hold the inclination angle when horizontal, but will walk to the right. In reality, due to intrinsic formation and bit anisotropy effects, additional deviation and walk tendencies will occur even under such special tool face settings.

To measure the tool face angle, survey sensors 16 are placed at a convenient axial location at some distance commonly above the knee 22 of the bent housing 18. The location of the survey sub 16 is frequently controlled by many factors, such as the need for formation evaluation sensor subs underneath and for directional control considerations. There may also be intervening stabilizers 20 between the bent knee 22 and the sensor sub 16, as well as between the bent knee 22 and the bit 24.

The survey sensors 16 typically include three accelerometers to directly determine the inclination angle, and three magnetometers to determine the azimuth angle of the well bore 12. The tool face angle is a by-product of these survey measurements once the initial reference tool face angle relative to one of the magnetometer orientations is determined prior to tripping in.

As used herein, the current tool face measurement is referred to as the "apparent tool face angle" because it is the orientation angle of the survey sensor sub 16, and not that of the bent housing knee 18. This difference can be very significant (in the order of two degrees or more), and can cause very undesirable drilled well profiles.

To adjust the tool face angle in accordance with the practice of the prior art, surface torque or rotation is applied until the apparent tool face angle appears to be correct. During the steering mode, the apparent tool face angle is normally continually monitored by suitable means, such as MWD measurements, to ensure the apparent directional control. Additionally, in high-angle or horizontal drilling, the general practice of the prior art is to employ a downhole drilling assembly that will provide higher build rates than actually needed. Drilling consists of a series of alternating sliding and rotary modes. In the sliding mode, only the downhole motor is used to drill for some section while setting the tool face at zero, in order to build at maximum rate. In the rotary mode, the entire downhole drilling assembly is rotated as well, which will result in a commonly perceived small dropping rate. The so-called "average" build rate is what is finally achieved. Such practice is also used to drill the horizontal section, which is, at best, a series of alternating build and drop sections. In such an alternating process, periodic tool face setting is required prior to each sliding drilling mode. In all of these situations, due to effects of formation and bit anisotropies, the drilling assembly will not actually drill into the pre-planned direction. Additional formation and bit-induced build-drop and walk tendencies will occur. As a result, even more frequent tool face settings are generally required.

There are two major problems in the setting and monitoring of the downhole tool face: (1) the measured tool face is not the true tool face; and (2) the amount of true tool face correction is not directly inferable. Due to the interference fit caused by the bend 22 of the bent housing 18, a very substantial locking contact force exists at the bent knee 22 and nearby contact locations, such as the upper and lower stabilizers, which prevents the knee plane from actually turning, unless the locking resistance is overcome. Therefore, while torque or rotation is being applied at the surface, even though the apparent tool face (at the measurement location some distance up hole) changes, the true tool face (at the bent knee) does not, unless the restraining torque due to the locking contact force at the knee is overcome. Furthermore, without knowing the precise value of the locking torque, larger torque is generally used to overcome such restraint, resulting in a sudden large rotation of the bend, which will be observable as a shift in the apparent tool face at the sensor location. This will probably require a reverse rotation to correct for the overshoot, and so on. Even without the large torque overcoming the locking resistance, the locking action may loosen up when the sliding mode drilling proceeds, thus resulting in the overshoot of the apparent tool face. The problem is further compounded by the possibility of a nonuniform well bore diameter due to rotary drilling, which may enlarge the borehole. Therefore, the entire process of tool face setting is in fact quite haphazard, and the actual drilling trajectory turns out to consist of many small segments of zig-zags with different azimuth angles. These zig-zags are in addition to the alternating build and drop sections in the rotary and sliding mode drilling. These zigzags can create a very large torque and drag to the drillstring, and lead to a reduced drillable extent, or even major drilling problems such as stuck pipes.

The present invention at the sensor sub 16 includes a torque sensor at substantially the same axial location where the tool face angle is being measured. By such an addition, it is possible to determine the relative rotational angle (called the "differential twist angle"), between the bent knee 22 and the location of survey sensors 16.

During tool face setting or monitoring operations, both the instantaneous tool face angle and torque are measured. The differential twist angle is calculated and subtracted from the tool face reading, resulting in a true tool face angle. Furthermore, the present invention contemplates a technique to find the amount of change needed for the apparent tool face angle in order to result in the required amount of change in the true tool face angle. The present invention relies on a rotational compliance diagram (shown in FIG. 4) of the downhole assembly. Additionally, other force measurements may be made, such as bending moment, which when combined with a BHA analysis, can yield very precise information about borehole conditions such as the caliper of the borehole, in addition to confirming the magnitude of the locking force. Since the magnitude of the bending moment near the bent knee is directly related to the amount of interference fit of the bent assembly, a smaller borehole will cause a larger bending moment, etc. The obtained caliper is very useful in the evaluation of torque and drag, and in deciding whether remedial reamer/wiper operations are necessary. Such caliper information is also very important for adjusting the results from the essential MWD formation evaluations measurements, which are critical for high-angle wells where wireline operations are difficult.

Figure 2:
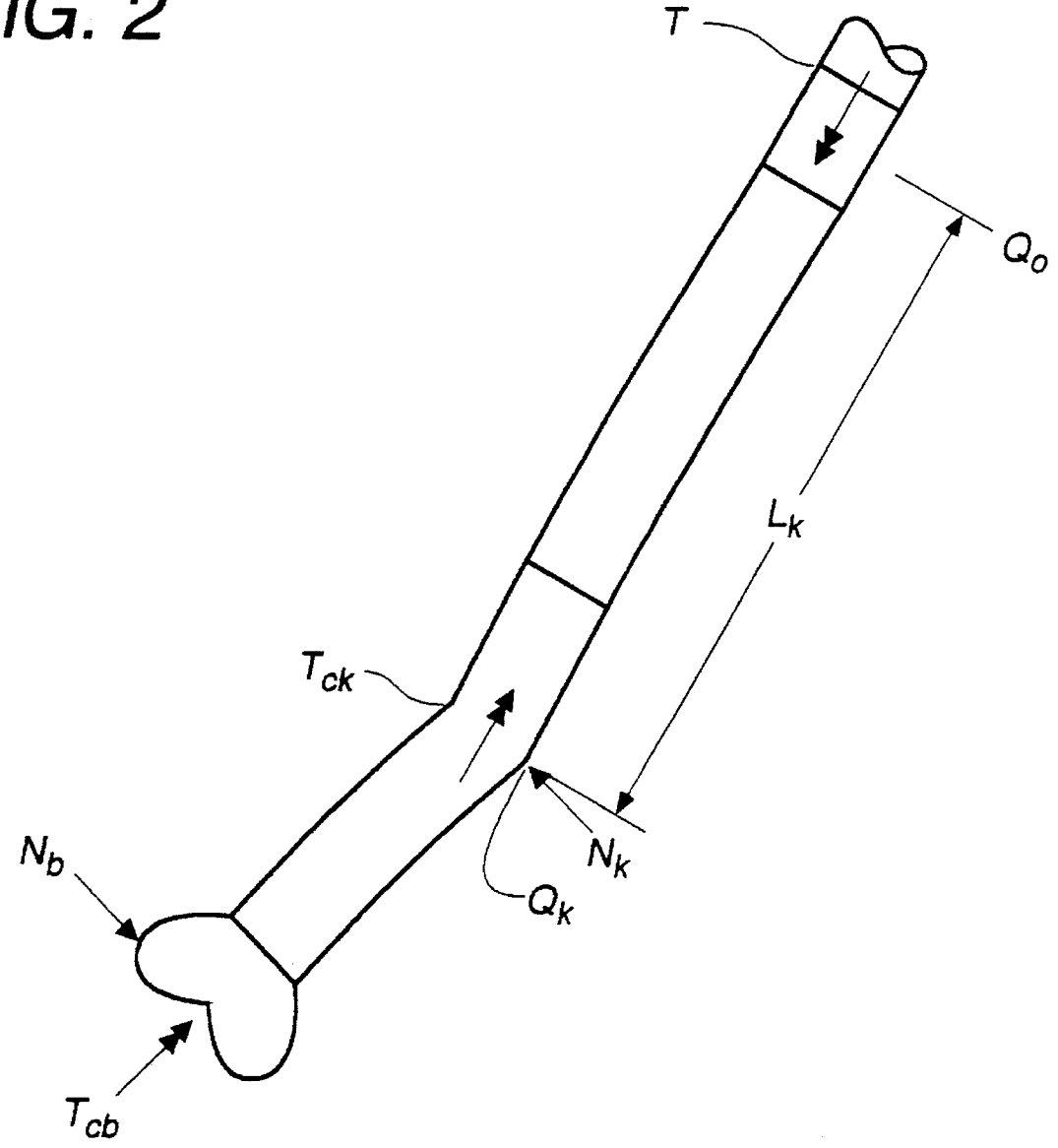
FIG. 2 is a schematic view of a segment of the downhole assembly between the sensor sub and the bit.

FIG. 2 shows a segment of the downhole assembly between the bent knee 22 at point $Q_k$, and the sensor measurement point, $Q_0$, at a distance of length $L_k$ uphole. In a preferred embodiment, no intervening contacts with the borehole exist within the length segment $L_k$. When a torque is applied at the surface to change the tool face setting, the value of the torque at $Q_0$ is measured to be T. This is referred to as the applied torque. In the ideal assembly situation where there are no intervening contacts existing between $Q_0$ and $Q_k$, the entire segment of the assembly will have the same torque T. Therefore, the differential twist angle $\delta\Theta$, which is the relative angle of rotation between these two points under the influence of T, is given by:

$$\delta\Theta = T\,L_k/(G\,J) \tag{1}$$

where G is the shear modulus of the assembly material, and J is the polar moment of inertia of the assumed uniform assembly section. The value C, defined as:

$$C = \delta\Theta/T = L_k/(G\,J) \tag{2}$$

is the rotational compliance of the tool-face setting system.

The differential twist angle $\delta\Theta$ is directly proportional to the distance between the bent knee 22 and the measurement point 16, as well as the torque being applied. In order to overcome the locking resistance, a very significant amount of torque, in the order of several ft-kips, may be required. It is also inversely proportional to the torsional rigidity of the assembly. For downhole motors, especially when drilling small diameter holes, this value becomes especially significant, reaching a few degrees.

If the assembly has non-uniform cross-sections and/or different materials within $L_k$, then a more detailed equivalent GJ can be used without difficulty.

Figure 3:
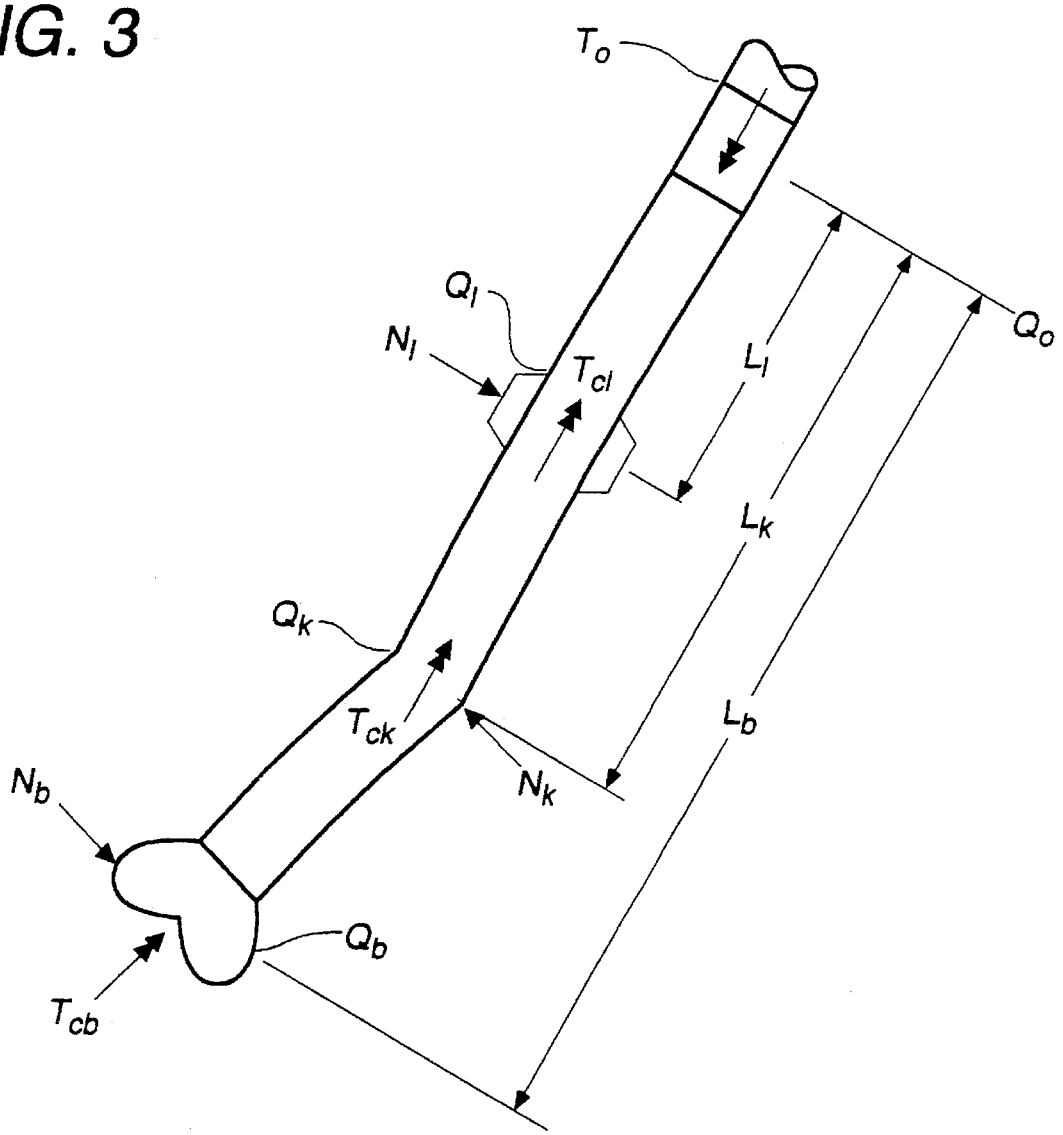
FIG. 3 is a schematic illustration of the downhole assembly in which a stabilizer is positioned between the sensor sub and the bit housing.

FIG. 3 shows a situation where an intervening contact with the borehole exists due to an intervening stabilizer 20, at $Q_1$, located at a distance $L_1$, from $Q_0$, between the knee and the sensor location. This configuration is often employed in the industry. It enables a simple estimation of the build rate of the drilling assembly by the three point rule. In such a configuration, there is a concentrated contact restraining torque of $T_1$ at $Q_1$. The torque in the assembly within the length segment of L is no longer uniform. A more sophisticated procedure is described below to infer the differential twist angle, etc.

The true tool face angle $\Theta_k$, is obtained from the apparent tool face angle $\Theta_0$ by subtracting an amount of correction which is the differential tool face angle:

$$\Theta_k = \Theta_0 - \delta\Theta \tag{3}$$

To change the true tool face angle, an additional operation is needed, since the bent knee 22 must be rotated. To infer the amount of bent knee rotation from the change in the apparent tool face angle requires the following process of determining the compliance diagram.

To obtain the differential twist angle, the true tool face angle, and the amount of change in the apparent tool face angle for a desired true tool face angle change for any downhole system configuration, a rotational compliance diagram of the setting system must be developed. This system can also be inversely analyzed and interpreted by plotting the applied torque as a function of the change in the apparent tool face angle, resulting in a the rotational impedance diagram.

Figure 4:
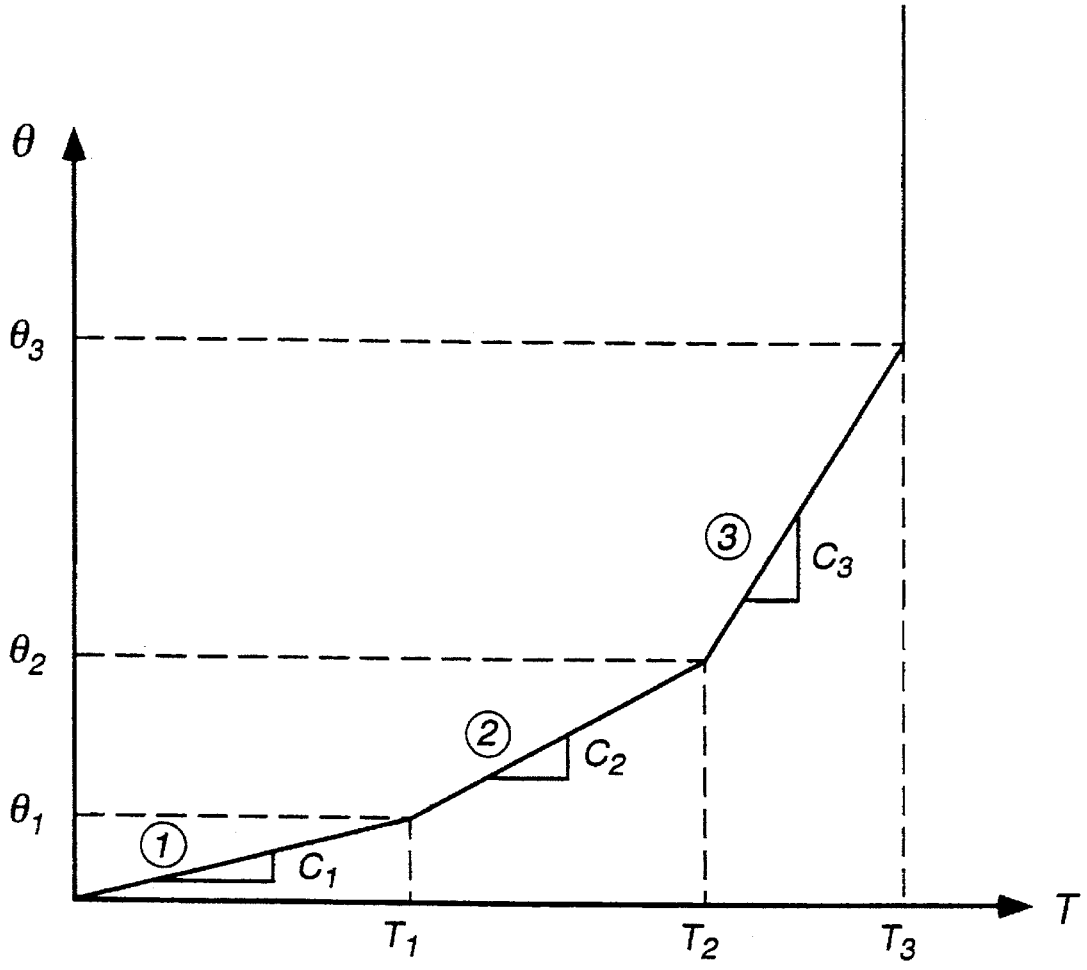
FIG. 4 is a representation of a compliance diagram corresponding to the downhole configuration of FIG. 3 in accordance with the present invention.

FIG. 4 shows the compliance diagram for the physical situation corresponding to FIG. 3. In the diagram, $\Delta\Theta$ is the change in the apparent tool face angle, measured from the reference state when the applied torque T is zero. The bit 24 is at point $Q_b$ at a distance $L_b$ from the sensor location. The restraining torques due to contacts at the three points $Q_1$, $Q_k$, and $Q_b$ are, respectively: $T_{c1}$, $T_{ck}$, $T_{cb}$. They are obtainable from multiplying the normal contact forces $N_1$, $N_k$, and $N_b$ by the rotational friction coefficients $\mu_1$, $\mu_k$, and $\mu_b$, and the radius of the assembly, That is: $T_{ck}=r_k$, $\mu_k$, $N_k$, etc. In respectively. = N , uniform formations, these friction coefficients should be the same.

The compliance diagram has three load regions as shown: low, intermediate, and high load regions, denoted by regions 1, 2, and 3, respectively in the diagram.

In region 1, the origin of the diagram represents the initial torque-free state of the assembly in section $L_1$ before any torque is applied. In region 1, $0 \leqq T \leqq T_1 = T_{c1}$ and $\Theta \leqq \Theta \leqq \Theta_1$. The upper limit ($\theta_1$, $T_1$) represents the instant when the applied torque T is large enough to overcome the restraining contact torque at point $Q_1$. Within this load region, the system behaves as if only the top section $Q_0\,Q_1$ exists. The $\Delta\Theta(T)$ diagram is the straight line shown previously:

$$\Delta\Theta = \delta\Theta = T\,L_1/(G\,J) \tag{4}$$

The compliance of the system is $C_1$, defined as:

$$C_1 = d\Delta\Theta/d\,T = L_1/(G\,J) \tag{5}$$

In the intermediate region 2, $T_{c1}=T_1 \leqq T \leqq T_2 = T_{c1}+T_{ck}$, and $\Theta_1 \leqq \Theta \leqq \Theta_2$. When the applied torque exceeds $T_1$, the remaining torque is exerted on the lower section to the bent knee location $Q_k$. This applies until the restraining torque at the knee, $T_{ck}$, is also overcome. The $\Theta(T)$ diagram, shown as region 2 in FIG. 4, is again a straight line:

$$\Delta\Theta = \frac{TL_l}{GJ} + \frac{(T - T_{c1})(L_k - L_l)}{GJ} \tag{6}$$

This equation can be rewritten as follows:

$$\Delta\Theta - \Delta\Theta_1 = \frac{(T - T_{c1})L_k}{GJ} \tag{7}$$

The rotational compliance is again the slope of the $\Delta\Theta(T)$ curve, and reflects the compliance of the assembly between the top and $Q_k$:

$$C_2 = d\Delta\Theta/dT = \frac{L_k}{GJ} \tag{8}$$

At the upper load limit $T_2=T_{c1}+T_{ck}$, the total elongation is $\Delta\Theta_2$ as follows:

$$\Delta\Theta_2 = \frac{T_{c1} L_l}{GJ} + \frac{T_{ck} L_k}{GJ} \tag{9}$$

In the highest region 3, $T_{c1}+T_{ck}=T_2 \leqq T_3 = T_{c1}+T_{ck}+T_{cb}$, and $\Delta\Theta_2 \leqq \Theta \leqq \Theta_3$. Relative to region 2, when the applied torque exceeds $T_2$, the remaining torque is exerted on the remaining lower section to the bit at $Q_b$. The $\Delta\Theta(T)$ diagram, shown as region 3 in FIG. 4, is again a straight line:

$$\Delta\Theta = \frac{TL_l}{GJ} + \frac{(T-T_{c1})(L_k-L_l)}{GJ} + \frac{(T-T_{c1}-T_{ck})(L_b-L_k)}{GJ} \tag{10}$$

Similar to load region 2, this equation can be rewritten as follows:

$$\Delta\Theta = \Delta\Theta_2 = \frac{(T-T_{c1}-T_{ck})\,L_b}{GJ} \tag{11}$$

The rotational compliance of the system now reflects that of the whole assembly:

$$C_3 = d\Delta\Theta/dT = \frac{L_b}{GJ} \tag{12}$$

Finally, when the torque overcomes the torque on bit $T_{cb}$, if it exists, then the following equation applies: $T_b=T_{c1}+T_{ck}+T_{cb}$. The total elongation is:

$$\Delta\Theta_3 = \frac{T_{c1} L_l}{GJ} + \frac{T_{ck} L_k}{GJ} + \frac{T_{cb} L_b}{GJ} \tag{13}$$

The torque cannot exceed the limit $T_b$. Rotation becomes unlimited beyond this load level. In this case, the rotational compliance becomes infinite.

The following interpretations are available for the compliance diagram: First, each load point on the compliance diagram represents a physical point on the assembly as the applied torque $T_0$ increases. Second, whenever the compliance diagram is a straight line between two points in the diagram, there are no intermittent contacts between the assembly and the borehole wall within the two corresponding physical points on the assembly. Third, the slope of the compliance diagram represents the compliance of the system within the prescribed load ranges. It determines the "effective support length" of the assembly, below which no torque is transmitted onto the assembly other than the pre-existing torque before the tool face setting torque is applied. Fourth, each "critical load point" on the compliance diagram, such as the starting point and the line intersection points, represents a physical point on the assembly where a concentrated contact restraining torque exists. The magnitude of this load is proportional to the discontinuity in the slopes of the diagram across the critical load point. And fifth, the location of the critical load point is determined by using the compliance (slope) between the lower load point and the next load point whose physical point is to be located.

To set the true tool face angle using the present invention, it is first necessary to establish the rotational compliance of the downhole tool system as described above. Secondly, all of the contact locations are established and the magnitudes of the contact restraining torques are determined. Relative to the example of FIG. 4, the load range 3 is selected where the applied torque just extends beneath the bent knee, that is, $T \geqq T_2$. Within this range, the change in the true tool face angle is $\Delta\Theta_k$, and depends on the applied torque according to:

$$\Delta\Theta_k=(T-T_2)(L_b-L_k)/(GJ) \tag{14}$$

when the torque is within the range $T_3 \geqq T \geqq T_2$. The differential twist angle is again $$\Delta\delta\Theta=\Delta\Theta-\Delta\Theta_k \tag{15}$$

where $\Delta\Theta$ is given by equation (10) or (11).

The above analysis is based on the assumption that the normal contact force, and therefore the restraining torque, remain unchanged during the rotation of the bent knee, namely when the true tool face is changed. This is the case if the borehole is a straight line.

For the more general curved borehole trajectory, the relative geometry of the downhole assembly and the confining borehole changes during the contact point rotation. There now exists a "nonlinear effect" due to the bent knee rotation when the knee "climbs" the borehole wall. This effect is small for small rotations of the contact points, but may be large for large rotations. This is compounded by the problem that the well trajectory beneath the survey sensor location is at best speculative.

To resolve this problem, additional procedures are needed. First, a suitable downhole assembly deformation analysis software is needed to analyze the contact condition for any given borehole trajectory and relative contact geometry. Secondly, the compliance diagram needs to be modified to account for the nonlinear effect, given known relative contact geometries. The single point at the bent knee will now correspond to a range in the compliance diagram, indicating the range of values needed to overcome the restraining torque. This range is dependent on the initial contact (tool face) angle. And thirdly, additional force resultant measurement(s) are useful. The most helpful measurements are the two-axes bending moments, measured at least at one appropriate axial location.

When the true tool face is changed, the bent knee will climb along the borehole wall. The accompanied change in the relative contact geometry will cause changes in the contact restraining torque, as well as the two-axes bending moments. Based on either empirical or a apriori computed information about the expected readings for any given well trajectory projection and relative orientation of the assembly, these force resultant measurements in conjunction with suitable analysis softwares, can be used to either inversely define the relative contact geometry, or, with suitable changes in the iterative algorithm, to infer other geometric parameters, such as the borehole caliber.

Multiple measurements of this type can be used to further define more of the defining geometric parameters, and reduce the need for initial assumptions. This will reduce the need for iterations required for convergent solutions matching computed results with the measured quantities.

The accurately infered borehole caliper is very important for other purposes, particularly for formation evaluation data analysis, where borehole diameter affects the correct interpretation of the MWD measurements, including the resistivity, porosity, and density of the surrounding formation.

The present invention also allows us to simultaneously correct for the effect of downhole assembly deformation on the inclination and azimuth angles of the well due to the present inaccurate reading of the true tool face angle. This is because error in the tool face reading will affect the relative contact geometry and the resulting assembly deformation, whose presence affects the true inclination and azimuth readings of the survey sensors, and need to be corrected.

It is important to note various terms that are used herein in relation to the claims and specification of the present invention. The term "drillstring" includes coiled tubing. The phrases "graphical relationship" and "graphical slope" refers to the formation of an actual physical graph and also includes the generation of information correlative of a two-axis representation of force versus movement. This representation can be a part of computer processing. The term "graphical curve" is inclusive of curves and/or straight line representations of relationships of physical quantities.

The foregoing disclosure and description of the invention is illustrative and explanatory thereof. Various changes in the details of the described method may be made within the scope of the appended claims without departing from the true spirit of the invention. The present invention should only be limited by the following claims and their legal equivalents.

NOMENCLATURES r: Radius of drillstring

L: Measured depth from sensor location downward toward bit

G: Shear modulus of drillstring

J: Polar moment of inertial of drillstring cross section

C: Rotational compliance

T: Applied torque, at the sensor location $\Theta_0$: Apparent tool face angle, at sensor location $\Delta\Theta_0$: Change in apparent tool face angle from zero applied torque state $_k$: True tool face angle, at the bent knee $T_2$: Magnitude of applied torque that just overcomes bent knee restraint $\Delta\Theta_k$: Change in true tool face angle under applied torque, $T-T_2$ N: Normal contact force Friction coefficient $T_b$: Torque constraint due to normal contact force,= μr N

I claim:

1. A method of determining a tool face angle in a well bore comprising the steps of:

determining an apparent tool face angle;

measuring torque at least at one axial location along a drillstring in the well bore;

correlating a change in said apparent tool face angle relative to a change in the torque so as to produce a graphical curve of the correlation; and identifying a slope discontinuity along said graphical curve, said slope discontinuity being indicative of a contact resistance between the drillstring and the well bore.

2. The method of claim 1, said slope discontinuity being a curve segment, said step of identifying the slope discontinuity comprising the step of:

computing a curvature of said curve segment, said curvature being representative of a distributed contact resistance along an area of contact between the drillstring and the well bore.

3. The method of claim 1, further comprising the steps of:

determining a differential twist angle from said graphical curve; and infering a true tool face angle by substracting said differential twist angle from said apparent tool face angle.

4. The method of claim 1, said step of determining the apparent tool face angle comprising the steps of:

measuring an inclination angle of the well bore; and measuring an azimuth angle of the well bore.

5. The method of claim 4, said step of determining the apparent tool face angle further comprising the step of:

attaching a sensor sub to a section of the drillstring above a bent housing on the drillstring, said sensor sub having a plurality of accelerometers and magnetometers thereon.

6. The method of claim 5, said step of measuring torque comprising the step of:

measuring said torque at substantially the same axial location as said sensor sub along said drillstring.

7. The method of claim 1, said drillstring having a bent housing thereon, said bent housing receiving a downhole motor therein, said step of identifying a slope discontinuity comprising the step of:

locating the slope discontinuity relative to a contact position below the bend of said bent housing.

8. The method of claim 1, said step of identifying the slope discontinuity comprising:

computing a slope of said graphical curve so as to yield an instantaneous rotational compliance under any given applied torque;

determining an effective depth of a contact load from said slope; and inferring a presence and a magnitude of a concentrated contact restraining torque from said slope discontinuity.

9. The method of claim 3, further comprising the step of:

adjusting the torque or rotation applied to the drillstring so as to obtain a desired true tool face angle.

10. The method of claim 1, further comprising the step of:

inferring an incremental torque relative to an incremental tool face angle from said graphical curve.

11. A method of setting a true tool face angle at a bent knee of a drillstring in a well bore comprising the steps of:

determining an apparent tool face angle;

measuring torque at least at one axial location along the drillstring;

correlating a change in said apparent tool face angle relative to a change in the torque so as to produce a graphical curve of the correlation;

identifying a plurality of slope discontinuities along said graphical curve, said slope discontinuities being indicative of points of contact between the drillstring and the well bore;

determining a slope associated with the discontinuity where the torque is applied to a contact below the bent knee; and determining an incremental torque required for any unit true tool face angle increment from said slope.

12. The method of claim 11, further comprising the step of:

applying torque or rotation to said drillstring so as to achieve a desired true tool face angle.

13. The method of claim 11, further comprising the steps of:

determining a differential twist angle from said graphical curve; and infering a true tool face angle by substracting said differential twist angle from said apparent tool face angle.

14. The method of claim 11, said step of determining an apparent tool face angle comprising the steps of:

measuring an inclination angle of the well bore; and measuring an azimuth angle of the well bore.

15. The method of claim 14, said step of determining the apparent tool face angle further comprising the step of:

attaching a sensor sub to a section of the drillstring above the bent housing on the drillstring, said sensor sub having a plurality of accelerometers and magnetometers thereon.

16. The method of claim 15, said step of measuring torque comprising the step of:

measuring said torque at substantially the same axial location as said sensor sub.

17. The method of claim 12, said step of applying torque comprising the step of:

adjusting the torque applied to the drillstring so as to obtain a desired tool face angle.

18. The method of claim 11, said drillstring having a bent knee affixed thereto, further comprising the steps of:

measuring at least two-axes bending moments along the drillstring at least one axial location; and modifying the graphical curve so as to reflect a variation in contact restraining torque during a rotation of the bent knee.

* * * * *